United States Patent [19]

Hild

[11] Patent Number: 5,054,748

[45] Date of Patent: Oct. 8, 1991

[54] MULTI-CHAMBER VACUUM INSTALLATION

[75] Inventor: Gerhard Hild, Asslar, Fed. Rep. of Germany

[73] Assignee: Arthur Pfeiffer Vakuumtechnik Wetzlar GmbH, Asslar, Fed. Rep. of Germany

[21] Appl. No.: 599,668

[22] Filed: Oct. 18, 1990

[30] Foreign Application Priority Data

Oct. 20, 1989 [DE] Fed. Rep. of Germany ..... 3935014

[51] Int. Cl.[5] ..... C21C 7/10

[52] U.S. Cl. ..... 266/208; 75/508

[58] Field of Search ..... 266/208; 75/508

[56] References Cited

U.S. PATENT DOCUMENTS

| | | | |
|---|---|---|---|
| 1,554,368 | 9/1925 | Rackoff | 75/508 |
| 3,501,289 | 3/1970 | Finkl | 75/508 |
| 3,999,984 | 12/1976 | Kawai | 75/508 |
| 4,294,611 | 10/1981 | Tamas | 75/508 |

*Primary Examiner*—Peter D. Rosenberg

*Attorney, Agent, or Firm*—Toren, McGeady & Associates

[57] ABSTRACT

A multi-chamber vacuum installation includes a charge-changing chamber (5) and a plurality of processing chambers (1, 2, 3, 4) located within the charge-changing chamber. One of the processing chambers (4) also serves as an air lock chamber. The air lock chamber (4) is formed of two parts, and inner part (**4*a*) and an outer part (4*b***). The inner part is secured to the inside and the outer part is secured to the outside of the charge-changing chamber.

3 Claims, 2 Drawing Sheets

MULTI-CHAMBER VACUUM INSTALLATION

BACKGROUND OF THE INVENTION

The present invention is directed to a multi-chamber vacuum installation including a charge-changing chamber and a plurality of process chambers located within the charge-changing chamber. Basically, such an installation is used for heat treatment, such as in smelting and casting plants or sintering facilities, where the material to be treated is subjected to cyclical treatment under vacuum conditions.

Such known installations have two or more chambers in which significantly different conditions exist such as pressure, temperature and gas composition. In cyclical operation the material to be treated, which must pass through several processing steps, is subjected consecutively in individual chambers to the different steps. To maintain the operating conditions within the chambers over a long operating period, the material to be treated must pass through an air lock when moving from the ambient atmosphere into a chamber or vice versa.

Such air locks are expensive components. They must be equipped with at least two valves, which have to meet very high requirements. In particular, use under vacuum conditions and at high temperatures requires special design measures, as for instance suitable material selection and additional cooling systems.

SUMMARY OF THE INVENTION

It is the primary object of the present invention to provide a multi-chamber vacuum installation where the above mentioned expense for locks is avoided and to afford a simple system for the transfer of material into and out of the installation through an air lock.

In accordance with the present invention, one of the processing chambers associated with the charge-changing chamber acts as an air lock chamber for introducing material to be treated into the charge-changing chamber and for removing treated material out of the chamber.

The processing-air lock chamber is formed of two parts, one connected to the inside of the charge-changing chamber and the other connected to the outside of the charge-changing chamber. The part of the processing-air lock chamber within the charge-changing chamber is connected to a device for moving the chamber part into the inside of the charge-changing chamber. Further, the part of the processing-air lock chamber connected to the outside of the charge-chamber is connected to an elevating-pivoting device so that it can be pivoted sideways.

By means of the present invention, the use of an additional air lock is rendered superfluous by using one of the existing processing chambers as an air lock chamber for introducing material to be treated into the charge-changing chamber and for removing the treated material from such chamber. The disadvantages mentioned above resulting from the use of an additional air lock are avoided. The entire installation is simpler in its construction, and is safer and easier to operate or service.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
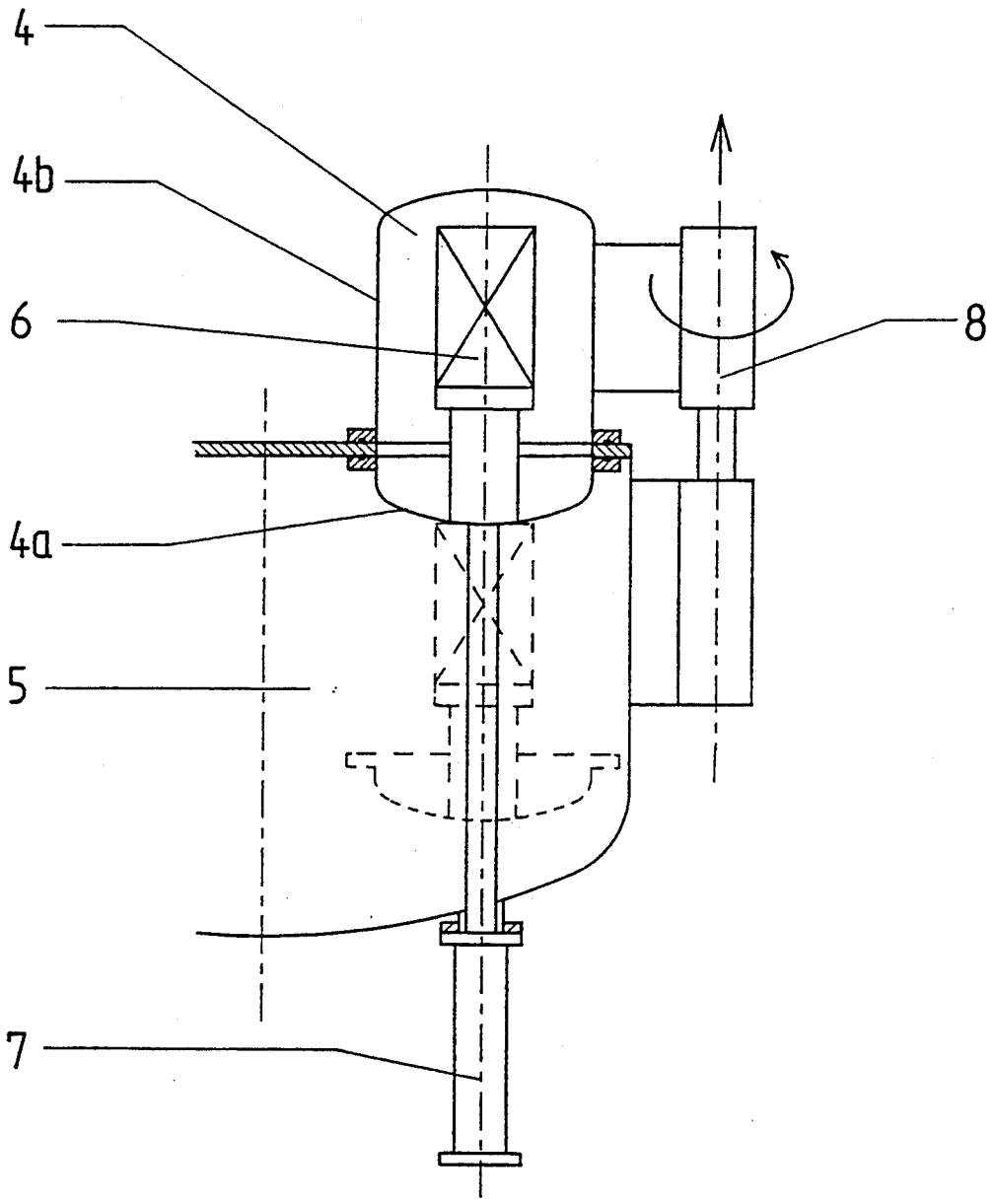
FIG. 1 is a schematic sectional view of a portion of a multi-chamber vacuum installation including an air lock chamber.
Figure 2:
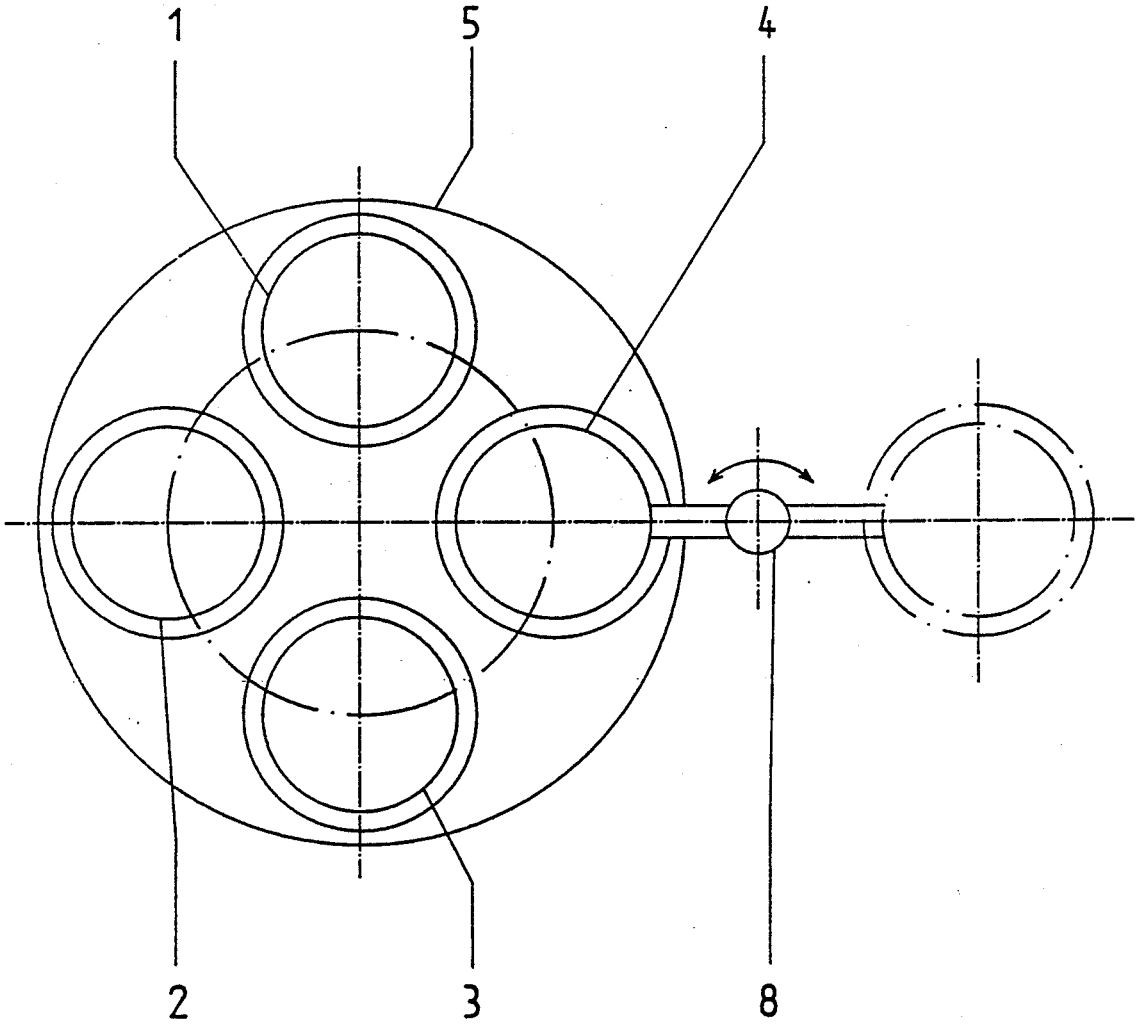
FIG. 2 is a schematic plan view of the multi-chamber vacuum installation.

FIG. 1 displays a portion of a multi-chamber vacuum installation in cross section. FIG. 2 illustrates a plan view of the entire installation. In the embodiment of the installation as shown, there are four processing chambers 1, 2, 3, 4 connected to one another by a charge-changing chamber 5. Processing chamber 4, in accordance with the present invention, also serves as an air lock chamber. The air lock chamber 4 has a lower part 4*a* and an upper part 4*b*.

Lower part 4*a* is connected with the inside of the charge-changing chamber 5 while the upper part 4*b* is connected to the outside of the charge-changing chamber. The connections of both parts 4*a*, 4*b* with the chamber 5 are vacuum-tight and detachable. A raising or elevating-pivoting device 8 is attached to the upper part 4*b* so that it can be raised and pivoted sideways, note the arrows in FIG. 1. In the raised and pivoted position, the upper processing-air lock chamber 4 can be loaded with a charge 6. A raising-lowering device 7 connected to the lower part 4*a* can position the charge within the charge-chamber 5 after equalization within the air lock chamber 4. From the position shown in FIG. 1 the charge can be transported by a known conveyor mechanism, not illustrated, to the other processing chambers 1, 2, 3. The movement of the charge out of the charge-changing chamber 5 occurs in the reverse sequence. Instead of using a single processing chamber as an air lock, it is possible to arrange several of the processing chambers as air locks.

While specific embodiments of the invention have been shown and described in detail to illustrate the application of the inventive principles, it will be understood that the invention may be embodied otherwise without departing from such principles.

I claim:

1. Multi-chamber vacuum installation comprising a housing forming a charge-changing chamber (5), and a plurality of angularly spaced processing chambers (1, 2, 3, 4) located within said charge-changing chamber for processing the material within the processing chambers in the charge-changing chamber, wherein the improvement comprises that one of said processing chambers (4) acts as an air lock chamber for introducing material to be treated into said charge-changing chamber and for removing treated material out of said charge-changing chamber, said processing-air lock chamber (4) comprises two parts (4*a*, 4*b*) with a lower part (4*a*) connected with the inside of the charge-changing chamber (5) and with an upper part (4*b*) connected with the outside of the charge-changing chamber and each connection of said lower part (4*a*) and upper part (4*b*) being vacuum tight.

2. Multi-chamber vacuum installation, as set forth in claim 1, wherein a raising-lowering device (7) is connected to the lower part (4*a*) of the processing air-lock chamber for moving a charge located within the processing-air lock chamber (4) into the charge-changing chamber (5).

3. Multi-chamber vacuum installation, as set forth in claim 1, wherein an elevating-pivoting device (8) is connected with said upper part (4*b*) of the processing-air lock chamber (4) for lifting said upper part and pivoting it sideways relative to said charge-changing chamber (5).

* * * * *